US006834940B2

(12) United States Patent
Sugioka et al.

(10) Patent No.: US 6,834,940 B2
(45) Date of Patent: Dec. 28, 2004

(54) LIQUID DISCHARGE HEAD AND RECORDING APPARATUS PROVIDED WITH THE LIQUID DISCHARGE HEAD

(75) Inventors: Hideyuki Sugioka, Kanagawa (JP); Takayuki Yagi, Kanagawa (JP); Takeo Yamazaki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 9 days.

(21) Appl. No.: 10/400,481

(22) Filed: Mar. 28, 2003

(65) Prior Publication Data

US 2003/0189621 A1 Oct. 9, 2003

(30) Foreign Application Priority Data

Apr. 4, 2002 (JP) ..... 2002-102509

(51) Int. Cl.[7] ..... B41J 2/05
(52) U.S. Cl. ..... 347/62; 347/65
(58) Field of Search ..... 347/18, 56, 62, 347/63, 65

(56) References Cited

U.S. PATENT DOCUMENTS

| | | | | |
|---|---|---|---|---|
| 4,296,421 A | | 10/1981 | Hara et al. | |
| 4,330,787 A | | 5/1982 | Sato et al. | |
| 5,706,041 A | * | 1/1998 | Kubby | 347/65 |
| 6,386,685 B1 | | 5/2002 | Sugioka | |
| 6,485,132 B1 | | 11/2002 | Hiroki et al. | |
| 6,499,833 B2 | | 12/2002 | Sugioka | |
| 6,557,975 B2 | | 5/2003 | Sugioka | |
| 2001/0048450 A1 | | 12/2001 | Sugioka | |
| 2002/0021332 A1 | | 2/2002 | Sugioka | |
| 2002/0021333 A1 | | 2/2002 | Sugioka | |
| 2002/0067396 A1 | * | 6/2002 | Kuk et al. | 347/65 |

FOREIGN PATENT DOCUMENTS

| | | |
|---|---|---|
| JP | 55-57477 | 4/1980 |
| JP | 61-59911 | 12/1986 |
| JP | 61-59912 | 12/1986 |
| JP | 61-59913 | 12/1986 |
| JP | 61-59914 | 12/1986 |
| JP | 62-94347 | 4/1987 |

* cited by examiner

*Primary Examiner*—Michael S. Brooke
(74) *Attorney, Agent, or Firm*—Fitzpatrick, Cella, Harper & Scinto

(57) ABSTRACT

A liquid discharging head for discharging liquid droplets utilizing generated bubbles by heating liquid to bubble comprises discharge port for discharging liquid droplets, bubbling chamber communicated with the discharge port for filling liquid; heat-generating member arranged in the bubbling chamber, being supported in a state of having gaps on both sides to the inner wall faces of the bubbling chamber; and supporting portion for supporting the heat-generating member. Then, after the generation of bubble in liquid by the heat-generating member, the sufrace temperature of the heat-generating member is made lower than the bubbling temperature at the time of bubble extinction by the heat radiation from the heat-generating member to the supporting portion side. In this way, it is made possible to prevent liquid from being heated again to generate bubble subsequent to the bubble extinction.

10 Claims, 4 Drawing Sheets

LIQUID DISCHARGE HEAD AND RECORDING APPARATUS PROVIDED WITH THE LIQUID DISCHARGE HEAD

BACKGROUND OF THE INVENTION

1. Field of the Invention

The present invention relates to a liquid discharge head that discharges liquid by the utilization of bubbles generated by heating liquid in flow paths for bubbling. The invention also relates to a recording apparatus that uses the liquid discharge head for recording information, such as images, characters, on a recording sheet, film, or some other recording medium.

Conventionally, the liquid discharge head is used for the application thereof in various fields, such as micro processing, experiment and analysis, image formation, among some others. Here, however, the description is made of the head of ink jet recording method as the example.

2. Related Background Art

The ink jet recording method, in which ink droplets are discharged for the adhesion thereof to a recording medium for recording images and the like, makes high-speed recording possible with the advantage that it performs recording in high quality with less noise. Further, the ink jet recording method makes it easier to record images in colors, and among many other excellent advantages, it can record on ordinary paper, and the like. Furthermore, the entire body of the apparatus can be made compact easily.

A recording apparatus that adopts the ink jet recording method of the kind is generally provided with a recoding head having discharge ports for enabling ink to fly for discharging it as ink droplets; ink flow paths communicated with the discharge ports; energy generating means arranged for a part of each ink flow path to give ink discharge energy for discharging it. Here, for example, there have been disclosed in the specifications of Japanese Patent Publication 61-59911, Japanese Patent Publication 61-59912, Japanese Patent Publication 61-59913, and Japanese Patent Publication 61-59914, respectively, a method for discharging ink by use of electrothermal converting element as energy generating means to enable thermal energy, which is generated by the application of electric pulses, to act upon ink.

The recording method disclosed in each of the aforesaid publications is such that a bubble is generated in ink with the action of thermal energy given to the ink, and by the force exerted by the action brought about by the abrupt expansion of such bubble, ink is discharged from each discharge port provided for the leading end of the recording head, and then, images are formed by the adhesion of the ink droplets discharged to a recording medium. In accordance with this method, it is possible to arrange discharge ports of the recording head in high density so that images can be recorded at high speed in high resolution and high quality. The recording apparatus that uses this method is therefore adoptable as information output means for a copying machine, a printer, facsimile equipment, and others.

For the ink jet recording method, the electrothermal converting element that has been described above should be provided, that is, it is necessary to provide a heat-generating member for heating liquid. Then, for the conventional ink jet recording method, there has been adopted a structure in which a thin resistive film is provided for the wall faces of the flow path, and electrodes are electrically connected to the two sides of the thin resistive film for the application of electric pulses.

However, when the thin resistive film is provided for the wall faces as described above, the thermal energy that has been generated by the thin resistive film is scattered and lost on the wall faces in a considerable proportion. As a result, efficiency is lowered in converting thermal energy into energy for bubbling use (bubbling energy), and in some cases, power dissipation becomes greater. In order to solve a problem of the kind, there has been disclosed in the specifications of Japanese Patent Application Laid-open No. 55-57477 and Japanese Patent Application Laid-open No. 62-94347 a liquid discharge head capable of reducing power dissipation by use of a heat-generating member that extends into the interior of each flow path, thereby to prevent heat from being scattered and lost in the recording head main body or the base plate thereof so as to effectuate the effective conversion of electric energy supplied to the heat-generating member into the bubbling energy.

However, the conventional liquid discharge head, which is structured to improve the efficiency of conversion of the supplied electric energy into bubbling energy by use of the heat-generating member that extends into the interior of the flow path as described above, makes it difficult to cause the heat of the heat-generating member to be diffused in the base plate. Therefore, it takes time to reduce the temperature of the heat-generating member after bubbling, and there exists a drawback that more time is required before transition to the next heating and bubbling can be made. Under the circumstances, it is difficult for the conventional liquid discharge head to repeat liquid discharges at high frequency.

Also, likewise, since the conventional liquid discharge head is structured so as to make it difficult for the heat of the heat-generating member to be diffused in the base plate, there is a drawback that the surface temperature of the heat-generating member cannot be reduced sufficiently by the time the bubble generated in the liquid is made extinct (hereinafter referred to as the time of bubble extinction). Thus, there is a fear that liquid is heated even after bubble extinction, thus generating a bubble again.

Further, if the phenomenon that the liquid is again heated after bubble extinction so that a bubble is generated again (hereinafter referred to as re-boiling phenomenon) should take place, the number of cavitation shocks given to the surface of the heat-generating member is increased. Thus, there is a fear that the durability of the heat-generating member deteriorates.

Also, when the re-boiling phenomenon occurs, it increases the refilling time, which is the time required for filling the flow path with liquid to be used for discharge prior to bubbling. This makes it difficult to repeat liquid discharges at high frequency.

SUMMARY OF THE INVENTION

Now, the present invention is designed with a view to solving the problems discussed above. It is an object of the invention to provide a liquid discharge head capable of suppressing the increase in time required for making the transition to the subsequent heating and bubbling for the heat-generating member, which is supported in a state of having gaps from both sides of the inner wall faces of a bubbling chamber, while preventing the occurrence of re-boiling phenomenon and making the power dissipation thereof smaller, and also, to provide a recording apparatus provided with such liquid discharge head.

In order to achieve the aforesaid object, the liquid discharge head of the present invention is a liquid discharge head for discharging a liquid droplet utilizing a generated bubble by heating liquid to bubbling, which comprises a discharge port for discharging a liquid droplet; a bubbling chamber communicated with the discharge port for filling liquid; a heat-generating member arranged in the bubbling chamber, being supported in a state of having gaps on both sides from the inner wall faces of the bubbling chamber, and a supporting portion for supporting the heat-generating member. Then, for this liquid discharge head, after bubble generation in the liquid by the heat-generating member, the surface temperature of the heat-generating member is made lower than the bubbling temperature at the time of bubble extinction, by heat radiation from the heat-generating member to the supporting portion side.

With the liquid discharge head of the invention thus structured, heat is radiated from the heat-generating member to the supporting portion side subsequent to having liquid bubbled and discharged by the heat-generating member. Thus, the surface temperature of the heat-generating member is made lower than the bubbling temperature at the time of bubble extinction, and the reboiling phenomenon at the time of bubble extinction is suppressed. Also, the liquid discharge head is arranged so that the heat-generating member is supported in a state of having gaps on both sides from the inner wall faces of the bubbling chamber where liquid is filled. In this way, it is made possible to prevent heat from being diffused in the base that supports the liquid discharge head and in the head supporting portion side. The electric energy supplied to the heat-generating member is converted into bubbling energy efficiently. In this respect, as for the structure that supports the heat-generating member, so long as the structure can support it without closing off the discharge port, it may be possible to support the heat-generating member either in a twin-beam fashion or in a single-beam (cantilever) fashion.

Also, the liquid discharge head of the present invention is formed to be flat by a thin resistive film, and first and second electrodes for applying an electric signal to the heat-generating member are provided in positions facing each other with the heat-generating member between them, and the heat-generating member bubbles liquid in the vicinity of both faces thereof, respectively.

As described above, the liquid discharge head of the present invention generates a bubble on both faces of the flat heat-generating member. Thus, as compared with the conventional heat-generating member, which is installed on the inner wall face of the liquid discharge head, the volume of bubble is made approximately twice as large, and the discharge energy of the liquid is enhanced accordingly. Also, in accordance with the liquid discharge head of the present invention, it becomes possible to obtain the same amount of discharge energy with a lesser amount of power dissipation as compared with the conventional liquid discharge head. In this respect, the shape of the heat-generating member may be one other than a flat shape.

Also, when a flat heat-generating member is used, only the heat-generating member is heated abruptly up to a temperature at which film boiling occurs in order to generate bubbles at the same time on both faces of the heat-generating member, respectively, for example. Thus, the temperature of the heat-generating member rises more than the bubbling temperature evenly in a short period of time. Therefore, variation in the bubbling times on the two faces of the heat-generating member is reduced, and bubbles can be generated simultaneously on both faces of the heat-generating member.

Also, for the liquid discharge head of the present invention, the supporting portion is provided with the first and second electrodes, and if the distance between the first electrode and the second electrode is $W_1$, the heat conduction distance of the heat-generating member at the time of bubbling is $d_1$, and the heat conduction distance of the heat-generating member at the time of bubble extinction is $d_2$, then the distance $W_1$ satisfies the condition: $2d_1<W_1<d_2$. In this manner, it becomes possible to make the surface temperature at the time of bubble extinction lower than the bubbling temperature, because the heat that may escape to the supporting portion side is made smaller at the time of bubbling.

Also, it is preferable for the liquid discharge head of the present invention that the liquid contains water, and the surface temperature of the heat-generating member is made 300° C. or less at the time of bubble extinction by heat radiation from the supporting portion. In this respect, it is more preferable that the surface temperature of the heat-generating member is made 100° C. or less at the time of bubble extinction.

Also, the liquid discharge head of the present invention is formed to be a thin film-laminated element having protection films laminated on both sides of the thin resistive film, and if the thickness D of the thin film-laminated element is larger than the value of $2d_1$ in the previous condition, the ratio of thermal energy that may escape to the supporting portion side is increased at the time of bubbling. As a result, the thermal energy that is converted into bubbling energy is made significantly small. This is not preferable. Therefore, $D<2d_1$ should preferably be satisfied. However, if the thickness D is extremely small, the strength of beam portion is lowered. This is not preferable, either. Typically, therefore, in consideration of such requirements as pulse width, material of the thin film-laminated layer, and volume of the liquid droplet, the thickness D of the thin film-laminated layer element should preferably be 0.1 $\mu$m or more and 12 $\mu$m or less, and more preferably, 0.5 $\mu$m or more and 3 $\mu$m or less, with respect to the aforesaid condition of the thickness D.

Also, the liquid discharge head of the present invention is provided with the heat-generating member having a bubbling region of an area $S_1$ on the front and rear sides, respectively; the front-rear communication path having a minimum aperture area $S_2$ to enable each bubbling surface on the front and rear sides of the heat-generating member to be communicated with each other; the ink supply port having a minimum aperture area $S_3$; and the discharge port having a minimum aperture area $S_4$, and it is preferable to make arrangements so that the conditions of $S_2>S_3$, $S_2>S_4$, and $S_1>S_4$ are satisfied, respectively. In this way, it becomes possible to enable bubbling on the rear and front faces of the heat-generating member to contribute effectively to discharging ink droplets, and also, to enhance the utilization efficiency of energy for the nozzles as a whole.

DETAILED DESCRIPTION OF THE PREFERRED EMBODIMENTS

Hereinafter, with reference to the accompanying drawings, the description will be made of the specific embodiments of an ink jet recording head in accordance with the present invention.

At first, particularly among those heads that adopt an ink jet recording method, the ink jet recording head (hereinafter referred to simply as recording head) of the present embodiment is provided with means for generating thermal energy as energy utilized for discharging liquid ink, and it adopts the method of effecting a change in the state of the ink by the application of thermal energy. By use of this recording method, characters, images, and the like may be recorded in high density and in high precision. The present embodiment is, particularly, a BJ (Bubble Jet) head that uses a heat-generating resistive element as a means for generating thermal energy, and discharges ink utilizing pressure exerted by a bubble generated by film boiling created by heating the ink by use of this heat-generating resistive element.

(First Embodiment)

Figure 1:
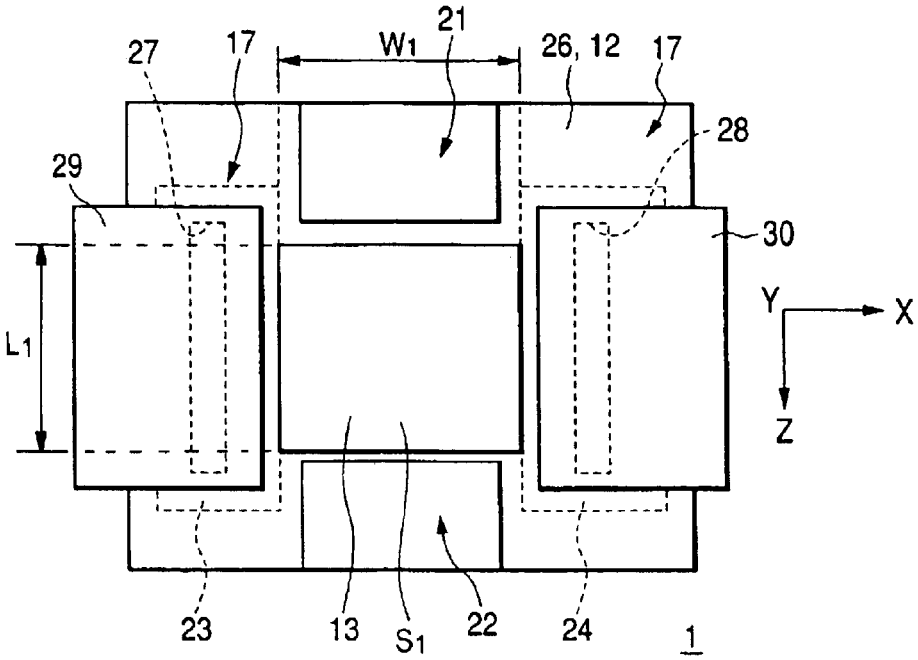
FIG. 1 is a plan view that shows an ink jet recording head in accordance with a first embodiment of the present invention, taken in the X-Z plane.
Figure 2:
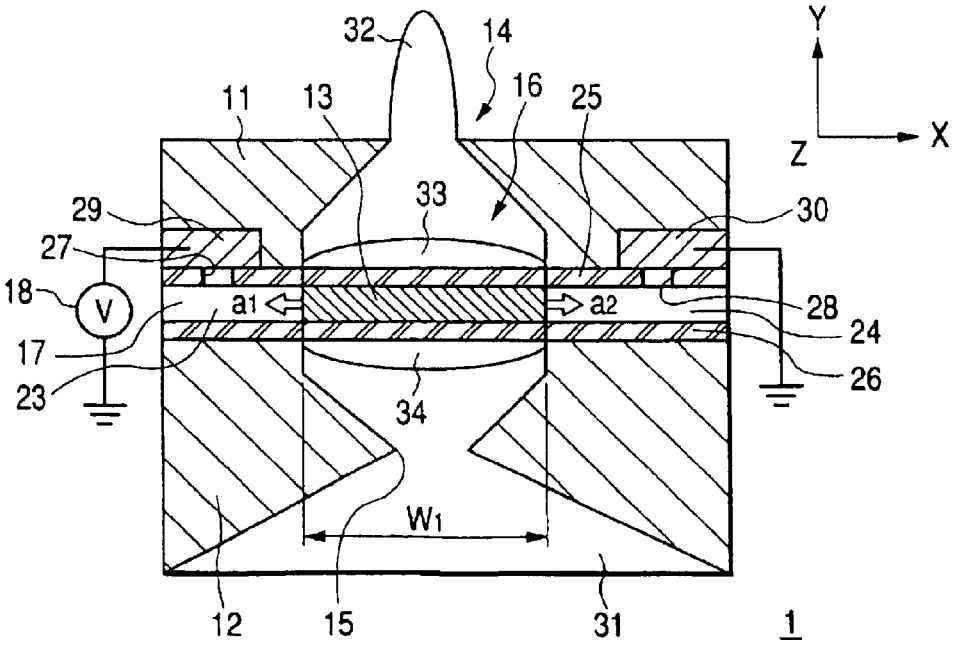
FIG. 2 is a cross-sectional view that shows the recording head, taken in the X-Y plane.
Figure 3:
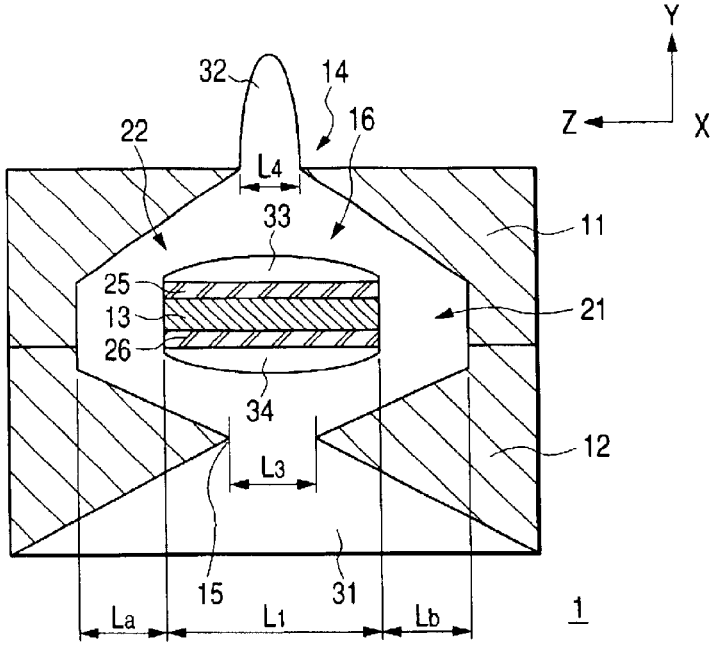
FIG. 3 is a cross-sectional view that shows the recording head, taken in the Y-Z plane.

FIG. 1 is a view that shows a recording head. FIG. 2 is a cross-sectional view that shows the recording head, taken in the X-Y plane. FIG. 3 is also a cross-sectional view that shows the recording head, taken in the Y-Z plane.

In FIG. 1, FIG. 2, and FIG. 3, the recording head 1 is provided with an orifice formation member 11 having a discharge port 14 for discharging ink droplets; a base plate 12 having an ink supply port 15; and a heat-generating member 13 for heating ink to bubbling. Also, the recording head 1 is provided with a bubbling chamber 16 in which ink supplied from the ink supply port 15 is filled; a supporting member 17 for supporting the heat-generating member 13 in a state where both faces thereof are arranged to have a predetermined gap with respect to the inner wall faces of the bubbling chamber 16; and a driving member 18 that applies electric signals to the heat-generating member 13 in order to enable the heat-generating member 13 to give heat only for a specific period of time $\Delta t$.

The heat-generating member 13 is formed by thin resistive film to be substantially flat. The bubbling chamber 16 is laid across the orifice formation member 11 and the base plate 12, and communicated with the discharge port 14. Also, on both inner sides of the bubbling chamber 16, front-rear communication paths 21 and 22 are arranged, respectively, with the heat-generating member 13 between them in order to enable ink to flow on the front side and rear side of the heat-generating member 13 as shown in FIG. 2 and FIG. 3.

The supporting member 17 is provided with the first and second electrodes 23 and 24, which are arranged, respectively, in positions facing each other with the heat-generating member 13 between them.

Then, on both faces of the heat-generating member 13, and the first and second electrodes 23 and 24, the insulating protection films 25 and 26 are laminated, respectively. Through the insulating protection films 25 and 26, these are laminated between the orifice formation member 11 and base plate 12. For the insulating protection films 25 and 26, contact holes 27 and 28 are provided, and through the contact holes 27 and 28, the electrical connection is made with the wiring electrodes 29 and 30 that supply electric power to the first and second electrodes 23 and 24.

Also, for the base plate 12, the ink supply path 31 is provided to supply ink into the bubbling chamber 16. To the ink supply path 31, ink is supplied from an ink supply portion (not shown).

Then, ink is supplied to the recording head 1 from the ink supply path side 31 through the ink supply port 15, thus filling ink in the bubbling chamber 16. The recording head 1 discharges ink droplet 32 from the discharge port 14 by means of bubbles 33 and 34 generated, respectively, on the two sides of the heat-generating member 13 by heat given to the ink by the heat-generating member 13.

In accordance with this recording head 1, heat is radiated from the heat-generating member 13 in the directions indicated by arrows $a_1$ and $a_2$ in FIG. 2 to the supporting member 17 side, respectively, subsequent to the generation of the bubble in the ink by the heat-generating member 13, and the surface temperature of the heat-generating member 13 is made lower than the bubbling temperature at the time of bubble extinction, thus suppressing the occurrence of the re-boiling phenomenon.

Also, with the front-rear communication paths 21 and 22, which are arranged, respectively, in the bubbling chamber 16 of the recording head 1, it is made possible to enable the bubbling on the rear side of the heat-generating member 13 to contribute to the performance of ink discharge. The heat-generating member 13 of this recording head 1 performs bubbling in the vicinity of both sides of the heat-generating member 13 arranged between the first electrode 23 and the second electrode 24, thus making it possible to utilize each of the bubbles efficiently on the faces of the front and back side of the heat-generating member 13. Therefore, as compared with the usual heat-generating member of one-side bubbling type, where bubbling is utilized only on one side, it is possible for this recording head to obtain bubbling energy approximately twice as much from the same energy supplied to the heat-generating member 13.

Also, the heat-conduction distance at the time of bubbling is generally shorter than the heat-conduction distance at the time of bubble extinction.

Therefore, it is made possible for the recording head 1 to heat the bubbling surface of the heat-generating member 13 at the time of bubbling, and to radiate heat at the time of bubble extinction to the first and second electrodes 23 and 24 sides, which serve as the supporting member 17, thus making the surface temperature of the heat-generating member 13 lower than the bubbling temperature at the time of bubble extinction. In this way, the occurrence of the re-boiling phenomenon can be suppressed.

Then, given the distance (width of the heat-generating member) between the first electrode 23 and the second electrode 24 as $W_1$; the heat conduction distance of the heat-generating member 13 at the time of bubbling as $d_1$; and the heat conduction distance of the heat-generating member 13 at the time of bubble extinction as $d_2$, the distance $W_1$ satisfies the following inequality (1) for the recording head:

$$2d_1 < W_1 < d_2 \quad (1)$$

With the selection of the distance $W_1$ as described above, the heat that may escape in the horizontal direction to the supporting portion 17 side becomes smaller at the time of bubbling, and also, it becomes possible to make the surface temperature of the insulating protection films 25 and 26 of the heat-generating member 13 lower than the bubbling temperature at the time of bubble extinction, hence making it possible to suppress the occurrence of the re-boiling phenomenon.

However, the heat conduction distance d at time t is defined as $d=2(\nu t)^{0.5}$ where the heat diffusion ratio is ν for a single material. Also, with respect to the thin film lamination layer of n layers having the thickness $L_j$, and the heat diffusion ratio $\nu_j$, (j=1, 2, 3, . . . n), d is defined as follows:

$$d=\{L_1 2\ (\nu_1 t)^{0.5}+L_2 2\ (\nu_2 t)^{0.5}+L_3 2\ (\nu_3 t)_{0.5}\ldots+L_n 2\ (\nu_n t)^{0.5}\}/L^{total}$$

where $L^{total}$ is the entire thickness of the film. Also, in the case of ink (liquid) the main component of which is water, the bubbling time indicates the time from the application of voltage to the heat-generating member until the surfaces of the insulating protection films 25 and 26 of the heat-generating member 13, which are in contact with the ink, reach a temperature of approximately 300° C. Also, the time of bubble extinction is the time needed for the bubble, which is generated and developed on the surface of the heat-generating member 13, to be shrunken to return to the surface of the heat-generating member 13 again. This is a time of approximately 10 μs after bubbling.

For the recording head 1 of the first embodiment, the heat-generating member 13 is formed with a poly-silicon layer approximately 1.0 μm thick, and the insulating protection films 25 and 26 are formed by an SiN layer approximately 0.25 μm thick. Also, the distance $W_1$ (=the width of the heat-generating member 13) is approximately 38 μm, and the pulse width of the electric signal is set at approximately 1.0 μs. Also, the energy, which is supplied to the heat-generating member 13, is set at a value of 1.2 times the threshold value needed for bubbling.

Consequently, the heat dispersion ratio of the heat-generating member 13 is $89.1\times10^{-6}$ $m^2/s$. The heat dispersion ratio of the insulating protection films 25 and 26 is $0.909\times10^{-6}$ $m^2/s$. Here, 2 $d_1$=24.5 μm and $d_2$=50.4 μm. Therefore, it is desirable to select the distance $W_1$ within a range of 24.5 μm<$W_1$<50.4 μm.

Figure 4:
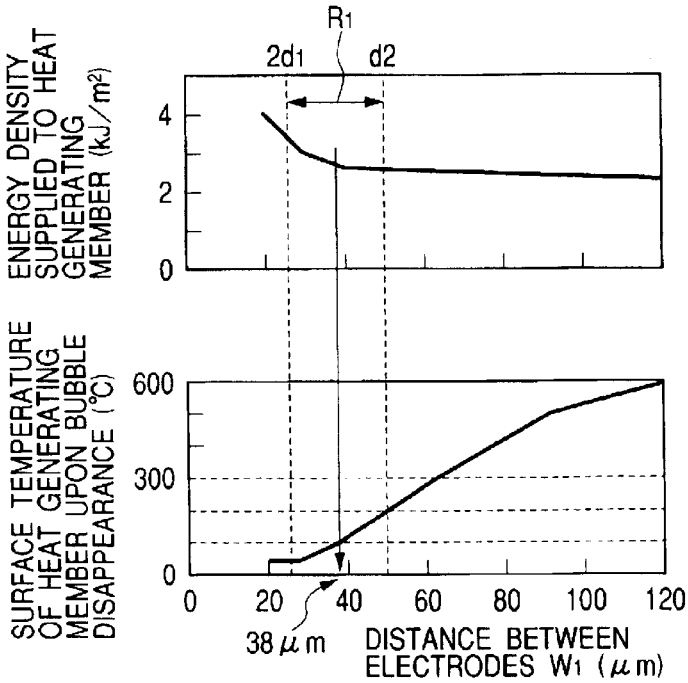
FIG. 4 is a view that illustrates the relations between the distance $W_1$, the surface temperature of the heat-generating member at the time of bubble extinction, and the density of energy supplied to the heat-generating member.

FIG. 4 is a view that shows the density of energy supplied to the heat-generating member 13 when applying voltage equivalent to the voltage that is 1.2 times the threshold bubbling voltage, and the dependability of the surface temperature of the heat-generating member 13 at the time of bubble extinction with respect to the distance $W_1$ across the electrodes. In FIG. 4, the range $R_1$ indicates the range $2d_1<W_1<d_2$. With the distance $W_1$ being set to satisfy such condition, an efficiency higher than that of the conventional heat-generating member can be achieved, because it is made possible then to prevent the efficiency from being lowered by heat dissipation to the supporting portion 17 side, while reducing the surface temperature of the heat-generating member 13 at the time of bubble extinction. In this way, the occurrence of the re-boiling phenomenon can be suppressed Also, as shown in FIG. 4, the density of energy supplied to the heat-generating member 13 with respect to the distance $W_1$, and the dependability of the surface temperature of the heat-generating member 13 at the time of bubble extinction are obtained so as to set the distance $W_1$ to a value that makes the surface temperature of the heat-generating member 13 at the time of bubble extinction lower than the bubbling temperature of the ink, hence making it possible to suppress the occurrence of the re-boiling phenomenon. Particularly, when the ink contains water, the bubbling temperature is approximately 300° C. In other words, the occurrence of the re-boiling phenomenon can be suppressed by making the surface temperature of the heat-generating member 13 300° C. or less, more preferably, 200° C. or less at the time of bubble extinction due to the contents of water in the ink and heat radiation from the supporting portion 17.

Also, if the surface temperature of the heat-generating member 13 is made almost 100° C. or less at the time of bubble extinction by heat radiation from the supporting portion 17, it becomes less than the water evaporation temperature in the equilibrium state. The effect of the re-boiling phenomenon suppression is increased. However, if the amount of lateral heat radiation should be increased more than necessary, there is a need for increasing the supply of energy as shown in FIG. 3. Here, the heat radiation is from the supporting portion 17, and the surface temperature of the heat-generating member 13 is made almost 100° C. at the time of bubble extinction. In this way, the occurrence of the re-boiling phenomenon is suppressed, while it is made possible to provide a recording head having a high efficiency of energy utilization.

Also, in accordance with the first embodiment, the heat-generating member 13 of the recording head 1 is the thin film-laminated element having the insulating protection films 25 and 26 arranged for both faces of the thin resistive film. If the thickness D of the thin-film-laminated element is as large a value as two times the heat conduction distance $d_1$ at the time of bubbling, the ratio of thermal energy escaping to the supporting portion 17 side is increased at the time of bubbling. This is not preferable because the thermal energy that should be converted into bubbling energy is considerably reduced. Therefore, it is preferable to satisfy the condition $D<2d_1$. Also, if the thickness D of the thin film-laminated element is extremely small, the strength of the beam portion is lowered. Therefore, this is also not preferable. Under the circumstances, in consideration of the pulse width, the material of the thin film-laminated element, and the volume of the ink droplet, among some others, the aforesaid condition of the width D of the thin film-laminated element is typically 0.1 μm or more and 12 μm or less, more preferably, 0.5 μm or more and 3 μm or less.

Here, the thin film-laminated element that forms the heat-generating member 13 is structured by the insulating protection films 25 and 26 formed by an SiN film 0.025 μm thick, and a poly-silicon thin resistive film layer formed in a film thickness of 1.0 μm. Therefore, the thickness of the heat-generating member 13 in the form of the thin film-laminated type is 1.5 μm. As has been described above, with the thickness of the heat-generating member 13 of the thin film-laminated type being made 0.1 μm or more and 12 μm or less, more preferably, 0.5 μm or more and 3 μm or less approximately, the thermal energy generated in the heat-generating member 13 contributes to bubbling on the front and rear sides of the heat-generating member 13, thus enhancing the utilization efficiency of energy.

Also, for the recording head 1 of the first embodiment, the distance $W_1$ is set at 50 μm or less. With the distance $W_1$ being made narrower approximately to 50 μm or less, positive heat radiation is made possible in the side directions, that is, the directions indicated by the arrows $a_1$ and $a_2$ (see FIG. 2), hence suppressing the re-boiling phenomenon.

As shown in FIG. 3, given the length of the heat-generating member 13 of the recording head 1, which is orthogonal to the distance $W_1$, as $L_1$; the distance between the inner wall faces and the side ends of the heat-generating member 13 as La and Lb; the aperture dimension of the ink supply port 15, which is parallel to the direction of the length $L_1$ of the heat-generating member 13, as $L_3$; and the aperture dimension of the discharge port 14, which is parallel to the direction of the length $L_1$ of the heat-generating member 13, as $L_4$, it is arranged to set $L_1$=38 μm, La=Lb=20 μm, $L_3$=20 μm, and $L_4$=20 μm. The aperture of the discharge port 14 is configured to be a square of $L_4 \times L_4$.

In other words, the recording head 1 is provided with the heat-generating member 13 (insulating protection films 25 and 26 are laminated on both faces), which is formed by a thin resistive film having a bubbling region of an area $S_1=W_1 \times L_1$, on the front and rear sides, respectively; the front-rear communication paths 21 and 22 having a minimum aperture area of $S_2=W_1 \times (La+Lb)$, which are communicated with the front and rear bubbling surfaces of the heat-generating member 13; the ink supply port 15 (narrowed portion) having a minimum aperture volume of $S_3=W_1 \times L_3$; and the discharge port 14 having a minimum aperture area of $S_4=L_4 \times L_4$. Then, $S_1=W_1 \times L_1=1444$ $\mu m^2$, $S_2=W_1 \times (La+Lb)=1520$ $\mu m^2$, $S_3=W_1 \times L_3=760$ $\mu m^2$, and $S_4=L_4 \times L_4=400$ $\mu m^2$. Each of these satisfies the conditions $S_2>S_3$, $S_2>S_4$, and $S_1>S_4$.

In other words, the recording head 1 is provided with the heat-generating member 13 having a bubbling region of area $S_1$ on the front and rear sides thereof, respectively; the front-rear communication paths 21 and 22 having a minimum aperture area $S_2$, which are communicated with the front and rear bubbling surfaces of the heat-generating member 13; the ink supply port 15 having a minimum aperture area $S_3$; and the discharge port 14 having a minimum aperture area $S_4$, which values satisfy the conditions $S_2>S_3$, $S_2>S_4$, and $S_1>S_4$, respectively. In this way, the recording head makes it possible to enable the bubbling on the rear side of the heat-generating member 13 to effectively contribute to discharging ink droplets, thus realizing a recording head having a high efficiency of energy utilization by the nozzles as a whole.

Next, the description will be made of the principle of liquid discharge of the recording head in accordance with the present embodiment. In a state where the bubbling chamber 15 is filled with ink, a pulse voltage is applied by the driving unit 18 to the heat-generating member 13 so as to raise the temperature of the heat-generating member 13 abruptly up to a temperature (300° C. or more) at which film boiling occurs. In this way, bubbles 33 and 34 are generated at the same time on the two bubbling surfaces, respectively, of the heat-generating member 13. Thus, abrupt expansion begins. Further, the bubbles continue to expand and push ink to the discharge port 14 side. When the bubbles continue to expand further, an independent ink droplet is formed, and then, the recording head 1 discharges the ink droplet from the discharge port 14. After that, the ink that remains in the bubbling chamber 15 without being drawn into the ink droplet joins ink in the ink supply path 31, thus returning to the initial condition.

Also, for the recording head 1, ink of 2.0 cps viscosity (20° C.) is supplied into the bubbling chamber 15 for discharging, for example. Here, the ink is prepared in such a manner that each of compound components, such as 3.0 weight % of C.I food black, 15.0 weight % of diethylene glycol, 5.0 weight % of N-metyl-2-pyrolidone, and 77.0 weight % of ion exchange water, is agitated in a mixing container and filtrated using a polyethylene fluoride textile filter having a 0.45 μm hole diameter, after being evenly mixed and dissolved.

(Second Embodiment)

Figure 5:
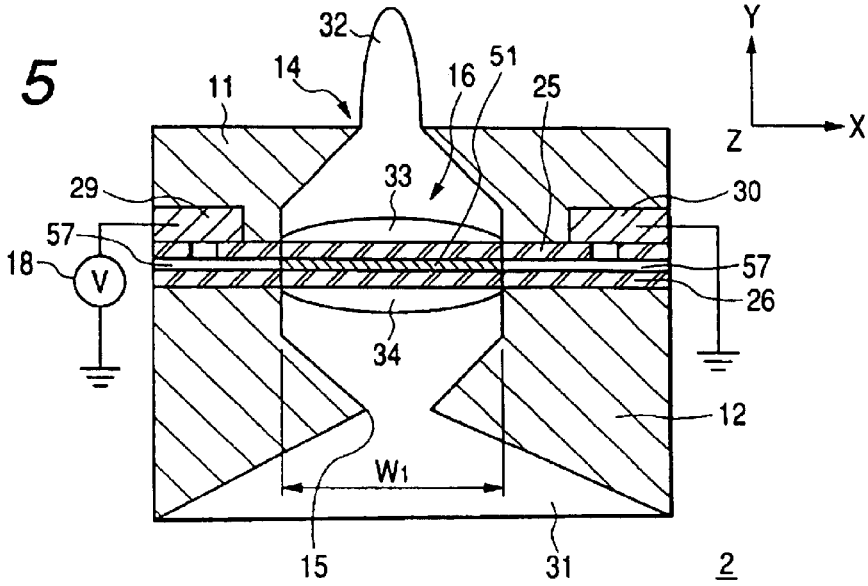
FIG. 5 is a cross-sectional view that shows a recording head in accordance with a second embodiment of the present invention.

Next, with reference to the accompanying drawings, the description will be made of a recording head that is provided with another heat-generating member in accordance with a second embodiment of the present invention. FIG. 5 is a cross-sectional view that shows the recording head in accordance with the second embodiment, taken in the X-Y plane. The fundamental structure of the recording head of the second embodiment is the same as that of the recording head described above with the exception of the heat-generating member. Therefore, the same reference characters are applied to the same members, and the description thereof will be omitted.

As shown in FIG. 5, in accordance with the second embodiment, the supporting portion 57 supports the heat-generating member 51 of the recording head 2, and all other structures are substantially the same as those of the recording head 1 of the first embodiment with the exception of the film thickness of the heat-generating member 51, which is formed to be smaller than that of the insulating protection films 25 and 26.

In accordance with the second embodiment, the film thickness of poly-silicon film that serves as the thin resistive film to form the heat-generating member 51 of the recording head 2 is approximately 0.1 μm, and smaller than the film thickness of 0.25 μm of the SiN insulating protection films 25 and 26. Also, the distance $W_1$ is set to be 18 μm.

In accordance with the second embodiment, the film thickness of the heat-generating member 51 formed by the thin resistive film is set to be smaller than that of the insulating protection films 25 and 26, hence minimizing the inner thermal energy of the heat-generating member 51, which can hardly be utilized. In this way, the energy utilization efficiency can be enhanced. Also, it becomes possible to make the thickness of the thin film-laminated layer type heat-generating member smaller as a whole. Therefore, the thermal energy generated inside the heat-generating member can be utilized more for bubbling on the front and rear sides.

Figure 6:
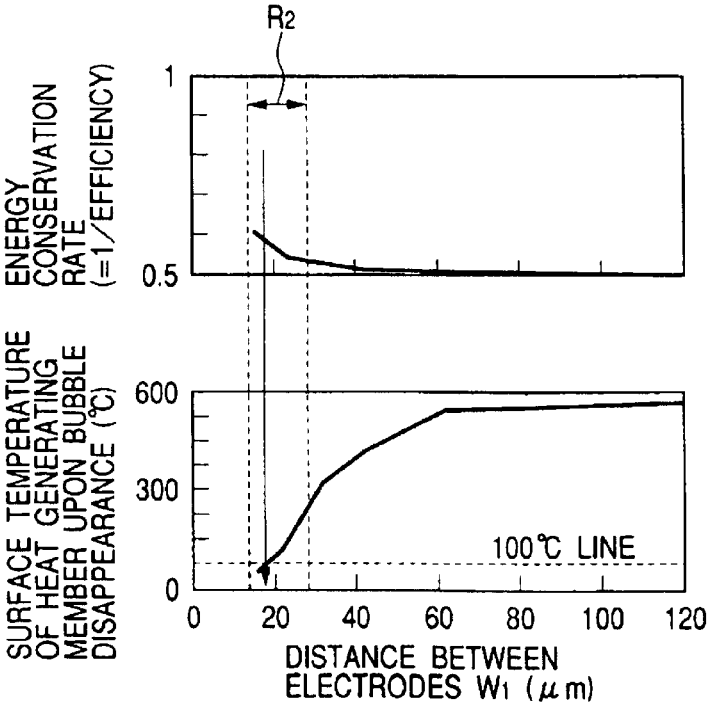
FIG. 6 is a view that illustrates the relations between the distance $W_1$, the surface temperature of the heat-generating member at the time of bubble extinction, and the efficiency of energy saving.

FIG. 6 is a view that shows the ratio between energy supplied to the heat-generating member 51 of the present embodiment, and energy supplied to the heat-generating member of one-side bubbling type (=energy saving ratio), as well as the dependability of the surface temperature of the heat-generating member 51 at the time of bubble extinction with respect to the distance $W_1$ when applying a voltage equivalent to a voltage of 1.2 times the bubbling threshold voltage.

The range $R_2$ shown in FIG. 6 indicates a range of$2d_1<W_1<d_2$. More specifically, this range $R_2$ indicates a range of 12.7 μm<$W_1$<25.8 μm. Then, if a distance $W_1$ that satisfies this condition is set, for example, $W_1$=18 μm (a square heat-generating member 51 of 18×18 μm), it becomes possible to make the energy saving ratio=0.6 (energy consumption can be curtailed by 40%), and also, to make the surface temperature of the heat-generating member 51 approximately 100° C. at the time of bubble extinction. Then, in accordance with the recording head 2, the reduction of efficiency, which is caused by heat dissipation to the supporting portion 57 side, can be suppressed, thus achieving a higher efficiency than that of the conventional heat-generating member, while lowering the surface temperature of the heat-generating member 51 at the time of bubble extinction. In this way, the re-boiling phenomenon can be suppressed.

(Third Embodiment)

Figure 7:
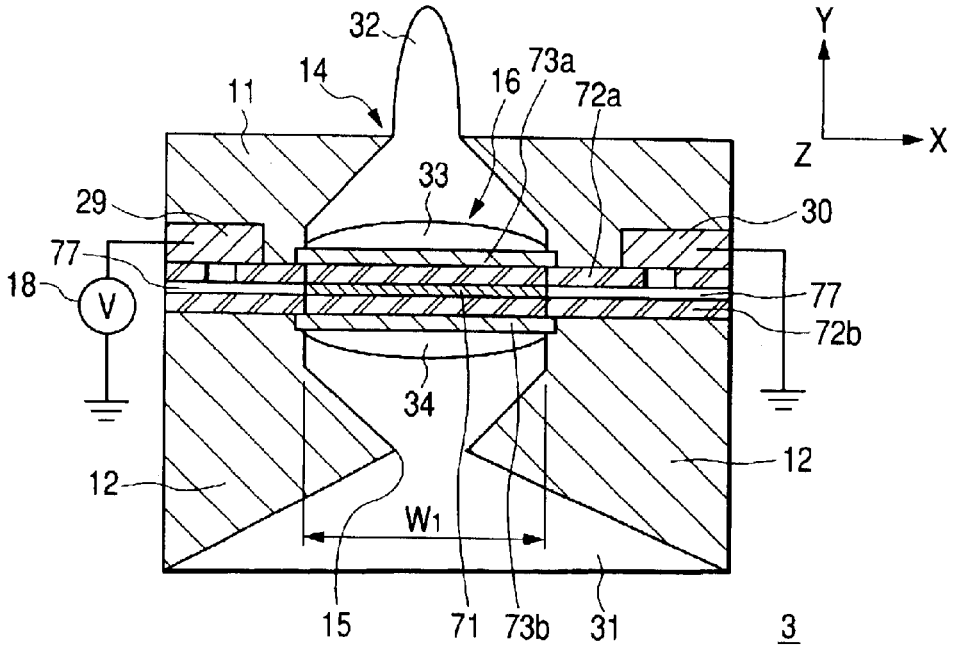
FIG. 7 is a cross-sectional view that shows a recording head in accordance with a third embodiment of the present invention.

Further, with reference to the accompanying drawings, the description will be made of a recording head provided with another heat-generating member in accordance with a third embodiment of the present invention. FIG. 7 is a cross-sectional view that shows the recording head in accordance with the third embodiment, taken in the X-Y plane. The fundamental structure of the recording head of the third embodiment is the same as that of the recording head described above with the exception of the heat-generating member. Therefore, the same reference characters are applied to the same members, and the description thereof will be omitted.

As shown in FIG. 7, in accordance with the third embodiment, the supporting portion 77 supports the heat-generating member 71 of the recording head 3, and metal protection films 73*a* and 73*b* for use as cavitation-proof films, which are formed of thin metallic film, are laminated on the insulating protection films 72*a* and 72*b*. All other structures of this recording head 3 are substantially the same as those of the recording head 1 of the first embodiment with the exception of the arrangement that the surface temperature of the heat-generating member 71 is lowered by heat radiation from the metal protection films 73*a* and 73*b* to the supporting portion 77 side.

For the recording head 3 of the second embodiment, the heat-generating member 71 is formed by a TaN thin resistive film prepared in a film thickness of 0.05 $\mu$m; the insulating protection films 72*a* and 72*b* are formed by an SiN film prepared in a film thickness of 0.3 $\mu$m; and the metal protection films 73*a* and 73*b* for use as cavitation-proof films are formed by a Ta thin film prepared in a film thickness of 0.25 $\mu$m. Also, the distance $W_1$ is set at 20 $\mu$m. In accordance with the third embodiment, heat is radiated to the supporting portion 77 side from the metal protection films 73*a* and 73*b* for use as cavitation-proof films laminated on the insulating protection films 72*a* and 72*b* in order to lower the surface temperature of the heat-generating member 71 at the time of bubble extinction, hence making it possible to effect heat radiation positively for the suppression of the re-boiling phenomenon.

For the recording head 3 of the third embodiment, the condition of $2d_1<W_1<d_2$ is specifically set to be $9.5\mu m<W_1<21.8\ \mu m$. Then, the distance $W_1$ is set at 20 $\mu$m, which satisfies this condition, thus making it possible to suppress the reduction of efficiency caused by heat dissipation to the supporting portion 77 side, and to lower the surface temperature of the heat-generating member 71 at the time of bubble extinction, while securing a higher efficiency than that of the conventional heat-generating member. In this way, the occurrence of the re-boiling phenomenon can be suppressed.

In this respect, the aforesaid recording head allows the generated bubble to be communicated with the air outside in the vicinity of the discharge port, and the volume of the discharged ink droplets is made constant to stabilize the discharge characteristics of the ink droplets. In order to enable the bubble and the air outside to be communicated, the distance between the heat-generating member and the discharge port is made smaller or the volume of the bubble is made larger by the application of a larger driving voltage, among some other methods applicable, for example.

Also, although not shown, a recording apparatus that uses the aforesaid recording head for recording images or the like on a recording medium, such as a recording sheet, makes it possible to perform high-speed recording with the provision of plural recording heads, and, further, to perform recording stably with the provision of a signal-supplying portion that supplies electric signals for generating film boiling by each of the heat-generating members of the recording head. Also, the recording apparatus of the kind makes it possible to realize high-quality recording with a high resolution at high speed by discharging ink droplets by use of the aforesaid plural recording heads.

Also, for the embodiments of the present invention described above, it is of course possible to arbitrarily modify the dimensions, materials, driving conditions, and others as design items for the base plate, orifice formation member, bubbling chamber, heat-generating member, discharge port, and the like.

What is claimed is:

1. A liquid discharge head for discharging a liquid droplet utilizing generated bubbles by heating the liquid to form the generated bubbles, comprising:

a discharge port for discharging the liquid droplet;

a bubbling chamber communicating with said discharge port for filling liquid;

a heat-generating member arranged in said bubbling chamber, being supported in a state of having a gap between said heat-generating member and an inner wall face of said bubbling chamber, on both sides of said heat-generating member; and a supporting portion for supporting said heat-generating member, wherein, after a bubble is generated in the liquid by said heat-generating member, a surface temperature of said heat-generating member is made lower than a bubbling temperature, at a time of bubble extinction, by heat radiation from said heat-generating member to said supporting portion, wherein said heat-generating member is formed to be flat, using a thin resistive film, wherein said supporting portion is provided with first and second electrodes for applying an electric signal to said heat-generating member, said first and second electrodes being provided in a position facing each other with said heat-generating member between them, wherein liquid is bubbled, respectively, in the vicinity of both faces of said heat-generating member, and wherein, if a distance between said first electrode and said second electrode is $W_1$, a heat conduction distance of said heat-generating member at a time of bubbling is $d_1$, and a heat conduction distance of said heat-generating member at the time of bubble extinction is $d_2$, the distance $W_1$ satisfies a condition of $2d_1<W_1<d_2$.

2. A liquid discharge head according to claim 1, wherein the liquid contains water, and a surface temperature of said heat-generating member is made 300° C. or less at the time of bubble extinction by heat radiation from said supporting portion.

3. A liquid discharge head according to claim 2, wherein the surface temperature of said heat-generating member is made almost 100° C. at the time of bubble extinction by the heat radiation from said supporting portion.

4. A liquid discharge head according to claim 1, wherein said heat-generating member is formed to be a thin film-laminated element having protection films laminated on both sides of said thin resistive film, respectively, and a thickness of said thin film-laminated element is 0.1 $\mu$m or more and 12 $\mu$m or less.

5. A liquid discharge head according to claim 4, wherein for said heat-generating member, a film thickness of said thin resistive film is smaller than that of either of said protection films.

6. A liquid discharge head according to claim 4, wherein said protection films are provided with a thin metallic film for use as a cavitation-proof film, and the surface temperature of said heat-generating member is lowered at the time of bubble extinction by heat radiation from said thin metallic film to said supporting portion.

7. A liquid discharge head according to claim 1, wherein the distance $W_1$ between said first electrode and said second electrode is 50 $\mu$m or less.

8.A liquid discharge head according to claim 1, wherein said heat-generating member forms a thin film-laminated element having a protection film laminated on each side of said thin resistive film, and if a thickness of said thin film-laminated element is D, and the heat conduction distance of said heat-generating member at the time of bubbling is $d_1$, a condition of $D<2d_1$ is satisfied.

9. A recording apparatus for recording on a recording medium by use of a liquid discharge head according to claim 1.

10. A liquid discharge head for discharging a liquid droplet utilizing generated bubbles by heating the liquid to form the generated bubbles, comprising:

a discharge port for discharging the liquid droplet;

a bubbling chamber communicating with said discharge port for filling liquid;

a heat-generating member arranged in said bubbling chamber, being supported in a state of having a gap between said heat-generating member and an inner wall face of said bubbling chamber, on both sides of said heat-generating member; and a supporting portion for supporting said heat-generating member, wherein, after a bubble is generated in the liquid by said heat-generating member, a surface temperature of said heat-generating member is made lower than a bubbling temperature, at a time of bubble extinction, by heat radiation from said heat-generating member to said supporting portion, wherein said heat-generating member is formed to be flat, using a thin resistive film, wherein, for said supporting portion, first and second electrodes for applying an electric signal to said heat-generating member are provided in a position facing each other with said heat-generating member between them, wherein liquid is bubbled, respectively, in the vicinity of both faces of said heat-generating member, and wherein said heat-generating member has a bubbling region of an area $S_1$ on front and rear sides thereof, respectively, front-rear communication paths having a minimum aperture area $S_2$ to enable bubbling surfaces on said front and rear sides of said heat-generating member to communicate with said paths, an ink supply port having a minimum aperture area $S_3$, and a discharge port having a minimum aperture area $S_4$, and the conditions of $S_2>S_3$, $S_2>S_4$, and $S_1>S_4$ are satisfied.

* * * * *